United States Patent [19]

Rolle et al.

[11] Patent Number: 4,648,560

[45] Date of Patent: Mar. 10, 1987

[54] SCREEN SEPARATOR METHOD FOR FOUNDRY WASTE MATERIALS

[75] Inventors: Thomas E. Rolle; David J. Nebel; John L. Shulan; William P. Liljestrom, all of Dubuque, Iowa

[73] Assignee: T.D.J. Co., Inc., Dubuque, Iowa

[21] Appl. No.: 748,626

[22] Filed: Jun. 25, 1985

[51] Int. Cl.[4] ..... B02C 19/12

[52] U.S. Cl. ..... 241/24; 209/2; 241/77

[58] Field of Search ..... 241/77, 81, DIG. 10, 241/24, DIG. 38; 209/2, 315, 316, 317

[56] References Cited

U.S. PATENT DOCUMENTS

| | | | |
|---|---|---|---|
| 551,772 | 12/1895 | King | 241/DIG. 10 X |
| 968,928 | 8/1910 | Frankenstein et al. | 209/316 X |
| 1,393,092 | 10/1921 | Davis | 241/DIG. 10 X |
| 1,999,312 | 4/1935 | Zeissl . | |
| 2,034,203 | 3/1936 | Piper | 241/DIG. 10 X |
| 2,063,506 | 12/1936 | Johnson . | |
| 2,297,169 | 9/1942 | Ross . | |
| 2,782,926 | 2/1957 | Saxe . | |
| 3,323,900 | 6/1967 | Takahashi et al. . | |
| 3,494,217 | 2/1970 | Tanaka et al. . | |
| 3,596,759 | 8/1971 | King et al. . | |
| 3,620,368 | 11/1971 | Comis et al. . | |
| 3,695,427 | 10/1972 | Friesz . | |
| 3,863,847 | 2/1975 | Day et al. | 241/24 X |
| 3,970,546 | 7/1976 | Webb et al. . | |
| 4,032,436 | 6/1977 | Johnson . | |
| 4,225,422 | 9/1980 | Trevoy et al. . | |
| 4,341,353 | 7/1982 | Hamilton et al. | 241/DIG. 38 X |

FOREIGN PATENT DOCUMENTS

| | | | |
|---|---|---|---|
| 111167 | 9/1979 | Japan | 241/DIG. 10 |

*Primary Examiner*—Mark Rosenbaum

[57] ABSTRACT

A method is provided of separating non-homogeneous materials, such as solid waste by-products from a foundry, by classifying the materials according to size through a series of classifying screens recognizing that particular types of materials within the entire sample tend to fall within certain size ranges permitting the sample to be sorted to a degree according to size to concentrate particular types of materials.

5 Claims, 2 Drawing Figures

FIG. 1
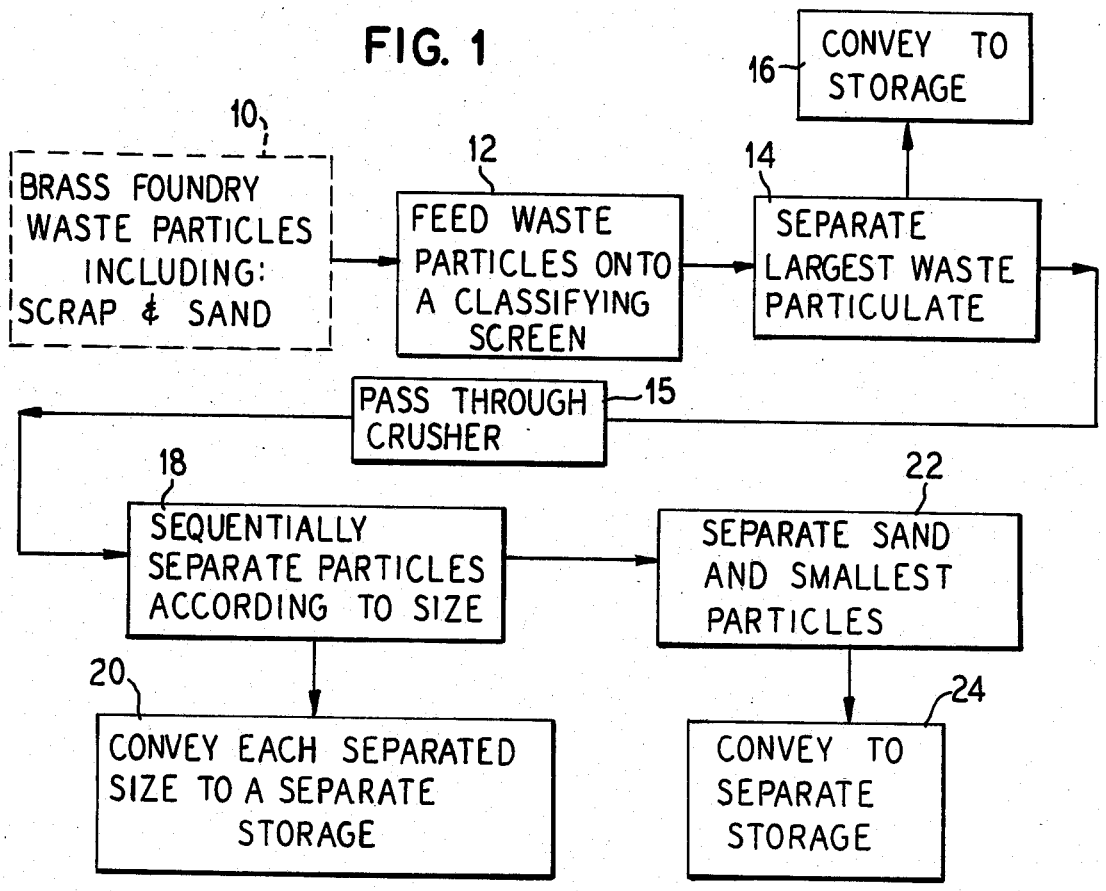
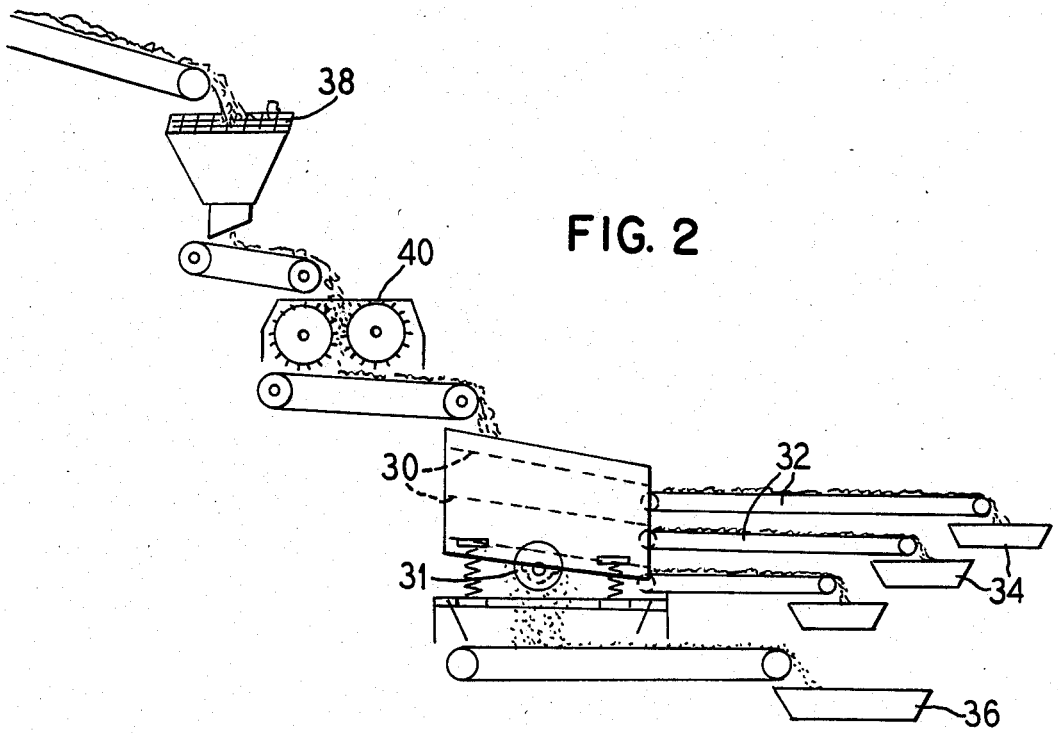
FIG. 2

SCREEN SEPARATOR METHOD FOR FOUNDRY WASTE MATERIALS

BACKGROUND OF THE INVENTION

1. Field of the Invention

The present invention relates to a method of classifying non-homogeneous materials of a solid, dry particulate nature such as those materials normally considered as waste materials or by-products from a foundry.

2. Description of the Prior Art

Various methods have been proposed for separating materials, especially homogeneous materials such as gravel from sand, or various sizes of gravel, by size or according to other characteristics. However, it has not been known, or thought useful in the past to separate the solid, non-homogeneous, dry waste output of foundries and other industrial or commercial sites according to the size of the particular materials in order to enhance the recycle value of the material.

SUMMARY OF THE INVENTION

The present invention provides a method for economically recycling the non-homogeneous by-products or waste materials from a foundry or other industrial plant including power plants, by classifying those materials by size in order to concentrate the valuable recyclable materials and to separate them from less valuable materials. The present invention contemplates the recognition that the waste by-products, for example the waste by-products of a brass foundry comprise a heterogeneous group of materials including brass which is a valuable recyclable material, sand, which is a less valuable recyclable material, other ferrous and non-ferrous metals as well as organic debris. It has been found through empirical studies that the bulk of the valuable recyclable material such as brass falls within a certain size range, namely ⅛" to 6" in diameter and the bulk of all less valuable recyclable material is in the range of greater than 6" in diameter or less than ⅛" in diameter.

In order to further enhance the concentrations of valuable recyclable materials, the range of ⅛" to 6" in diameter is divided into a plurality of segments, each segment having a particular value per pound of material so classified depending on the characteristics of the individual dump site.

By employment of the method of the present invention, previously discarded materials which were merely put into dump sites can economically be recycled and the volume of the non-recyclable by-products can be greatly reduced. Employment of the present invention thus not only conserves scarce resources by recycling various materials, it also assists in enhancing the quality of the environment in that waste sites can be cleaned up and reduced in size.

BRIEF DESCRIPTION OF THE DRAWINGS

FIG. 1 illustrates the steps of the method of the present invention.

FIG. 2 is a schematic illustration of a device operable to perform the method of the present invention.

DETAILED DESCRIPTION OF THE PREFERRED EMBODIMENTS

Although the method of the present invention can be utilized to classify a wide range of material from a diverse source input including foundries, power plants, industrial plants, etc., the description of the invention will be related to its use at a brass foundry, recognizing that the invention is not limited to use at such a location, but that it is useful at a diverse range of locations.

Through empirical study, it has been found that the waste by-products of a brass foundry include a varied collection of materials including brass particles, spatterings, flashings, other metallic particles, coke-like material, sand, oxides, scale, organic debris and inorganic debris and various other materials. It has further been determined through the empirical study that those waste by-products which are not valuable in terms of recycling, or which can easily be separated manually, tend to be larger than 6 inches in diameter. Further, particles which are less than ⅛ of an inch in diameter tend primarily to be sand particles and the separation of any valuable recyclable material, such as small brass particles from the sand particles is not feasibly accomplished by a mechanical separator method. Further, some materials such as coke can be easily crushed into small particles for separation purposes.

Therefore, the method of the present invention comprises mechanically separating or classifying the heterogeneous material from a brass foundry (or other source) according to size in accordance with the steps shown in the FIG. 1. The waste by-product particles and debris shown generally at 10 are collected and are fed onto a first classifying screen in the step indicated at 12, this first screen having a grid opening size of approximately 6" to cause debris greater than 6" to be retained on the screen and particles less than 6" to fall through the screen. The separation step is shown in box 14 and the materials left on top of the screen, those being larger than 6", are conveyed to a storage location as indicated by box 16.

After the materials pass through the first classifying screen, they are fed through a roller crusher in step 15 in which non metallic materials are crushed to a size generally less than ⅛".

The materials which have passed through the roller crusher in step 15 are sequentially passed through decreasing grid size screens as indicated at step 18 and the material collected at each screen is conveyed to a distinct storage location as indicated at step 20.

The final screen size which is usually in the range of ¼" to ⅛" permits primarily sand and crushed particles to pass through as shown in step 22, although there are small brass particles and other small materials which will also fall through. However, the largest volume of materials passing through the final classifying screen will represent sand. This sand is conveyed to a separate storage location as shown in step 24.

The sequential separation of the particles in step 18 which are each conveyed to separate storage locations at step 20 comprises a recognition that concentrations of valuable recyclable materials vary according to the size of the particles. Therefore, the value of the collected materials from each screen size will vary and the screen sizes can be selected to obtain an economical recyclable mixture according to the actual composition of the waste by-products of the particular foundry at which the method is being utilized.

In practice, the classification screens 30 can be set at an angle as shown schematically in FIG. 2 and can be constantly agitated or vibrated by an appropriate vibration means 31 to cause the materials which are stopped by each particular screen to slide down the screen onto a separate conveyor belt 32 to be directed to the distinct separate storage locations 34. The very small particulate material which passes through the final screen will comprise primarily sand and it can be collected directly in an appropriate collection device 36.

It has been found through initial testing that the first screen 38 should have a grid size of approximately 6" to separate the largest waste particles which are not particularly valuable for recycling purposes or which can easily be manually sorted. The final screen should be generally not smaller than ⅛ of an inch and multiple screens can be used in between, for instance ¾" and ½" grid sizes, to separate the particles into distinct size groups. By varying the particular screen sizes, and particularly the first and last screen sizes, the concentration of valuable recyclable materials can be enhanced while reducing the initial waste by-product storage pile. In this manner, the detrimental environmental impact of the waste by-product of the foundry can be reduced and valuable natural resources can be conserved through the recycling of certain materials.

Between the first screen 38 and the classifying screen 30 the roller crusher 40 is interposed to crush non metallic materials, such as coke, into particles generally less than ⅛" in diameter The rollers are arranged, such as by spring loading, to permit larger metallic particles to pass without binding or overloading the crusher.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim:

1. A dry separator method of classifying non-homogeneous waste by-products from a brass foundry including valuable brass materials, scrap materials and and in order to concentrate valuable recyclable materials such as said brass materials and separate them from less valuable materials comprising:

feeding said non-homogeneous by-products onto a first classifying screen with a mesh size of approximately 6 inches to separate large less valuable waste particles which are conveyed to a storage location and thus concentrate the valuable recyclable materials, sequentially separating the remaining non-homogeneous materials through additional screens with progressively smaller screen openings wherein a final screen has a mesh size of no more than ¼ inch, separately collecting the concentrated valuable recyclable materials from each classifying screen, conveying each collected group of materials to a discrete storage location, and conveying the smallest particles which have passed through all of the classifying screens and which comprise less valuable materials, to a discrete storage location.

2. A method according to claim 1, wherein said screens are vibrated as material is introduced to them.

3. A method according to claim 1 wherein a last screen has a grid opening size in the range of ¼ to ⅛ inches.

4. A method according to claim 1, including the step of crushing non-metallic particles which have passed through said first classifying screen.

5. A dry separator method of classifying non-homogeneous waste by-products from a brass foundry including valuable brass materials scrap materials and sand in order to concentrate valuable recyclable materials such as said brass materials and separate them from less valuable materials comprising:

feeding said non-homogeneous waste by-products onto a first angled and vibrating classifying screen having a grid opening size of approximately 6" to separate large less valuable waste particles and thus concentrate the valuable recyclable materials, collecting the separated particles from said first screen as they slide off the angled vibrating screen, transporting the separated large less valuable particles by a moving conveyor system to a discrete storage location, feeding the remaining materials to a crushing apparatus to crush less valuable non-metallic materials to a size of no greater than ¼ to ⅛ inches in diameter, sequentially separating the remaining materials through additional angled and vibrating screens with progressively smaller screen openings, separately collecting the concentrated valuable recyclable materials as they slide off each classifying screen, conveying each collected group of materials to a discrete storage location by means of separate conveyor systems, and conveying the smallest particles which have passed through a final classifying screen with a grid opening size in the range of ¼ to ⅛ inches and which comprise less valuable materials to a discrete storage location.

* * * * *